US007784383B2

(12) United States Patent
Salva et al.

(10) Patent No.: US 7,784,383 B2
(45) Date of Patent: Aug. 31, 2010

(54) JEWELRY AID

(76) Inventors: Peter Salva, 140 Split Cedar Rd., Islandia, NY (US) 11749; Patrick Riordan, 1623 Wantagh Ave., Wantah, NY (US) 11793

( * ) Notice: Subject to any disclaimer, the term of this patent is extended or adjusted under 35 U.S.C. 154(b) by 97 days.

(21) Appl. No.: 12/008,313

(22) Filed: Jan. 10, 2008

(65) Prior Publication Data

US 2008/0168869 A1 Jul. 17, 2008

Related U.S. Application Data

(60) Provisional application No. 60/880,357, filed on Jan. 12, 2007.

(51) Int. Cl.
*B25B 7/02* (2006.01)

(52) U.S. Cl. ..... 81/302; 81/426; 81/485; 81/486; 223/111

(58) Field of Classification Search ..... 81/302, 81/424.5, 426, 426.5, 485, 486; 223/111, 223/DIG. 2; 24/499, 507; 29/229, 225; 433/4
See application file for complete search history.

(56) References Cited

U.S. PATENT DOCUMENTS 1,304,720 A * 5/1919 Young ..... 433/4
2,564,752 A * 8/1951 Collins ..... 81/3.6
2,603,849 A * 7/1952 Epperson ..... 24/507
2,629,114 A * 2/1953 Peterson ..... 81/424.5
2,797,019 A * 6/1957 Larson ..... 81/426
2,803,320 A * 8/1957 Wagner ..... 52/214
3,218,696 A * 11/1965 Dritz ..... 29/770
5,855,401 A 1/1999 Papernik
5,934,526 A 8/1999 Rosenbaum
6,036,065 A 3/2000 Wofford
D440,739 S 4/2001 Hsu
6,553,636 B1 4/2003 Brenner
6,854,625 B2 2/2005 Tedeschi

* cited by examiner

*Primary Examiner*—D. S Meislin
(74) *Attorney, Agent, or Firm*—Harold G. Furlow, Esq.

(57) ABSTRACT

An aid for the connecting of a piece of jewelry together that has a pliers type construction. The aid includes a first handle and a first jaw connected by a pivotal joint with a second handle and a second jaw. The first jaw has a distal end portion with an inwardly facing surface that defines a notch. The second jaw has an elongate arcuate distal end portion that fixes the position of a biased clasp of a piece of jewelry. The notch of the first jaw engages a lever of the clasp and opens the clasp while it is fixed in position by the second jaw. The aid includes a bias that urges the jaws to a closed position and retains the clasp in an open position.

18 Claims, 2 Drawing Sheets

JEWELRY AID

CROSS-REFERENCE TO RELATED APPLICATIONS

This application claims priority to provisional application 60/880,357 filed Jan. 12, 2007, the disclosure of which is incorporated by reference herein and made a part of this application.

FIELD OF THE INVENTION

The present disclosure relates to aids for the wearing of jewelry and in particular to aids for the fastening and unfastening of jewelry connectors.

BACKGROUND OF THE INVENTION

Jewelry such as necklaces, anklets and bracelets frequently have connectors that are difficult to grasp, easily retain in an open position and securely latch. Part of this problem is the fine delicate nature of many of these pieces of jewelry, but the jewelry latching process is further complicated by the limitations of the fastener and/or wearer to successfully manipulate and fasten the connectors of the piece of jewelry together.

For example, the fastening of a typical lobster claw or spring ring type clasp requires the manipulation of a small lever that extends from the annular ring of the clasp to actuate to the opening and closing of the clasp. The lever can be difficult to visually or tactilely find, manipulate and retain in an open position against the bias of the clasp. The fastener then has to place the opposing connector of the piece of jewelry into the narrow opening of the clasp and release the lever to fasten the connectors together.

This difficult process of fastening the clasp and opposing connector of a piece of jewelry can be increased by the inability of the fastener to see, align and fasten the connectors of the jewelry together. Other factors that can complicate this process are long fingernails and disabilities such as arthritis that increase the manual strain of what should be a simple process. This difficult jewelry fastening process reduces many wearers to attempt to latch the connectors by trial and error. This can be sufficiently frustrating and painful that in many instances when the fastener is also the wearer the person is compelled to seek additional assistance or stop wearing jewelry altogether.

While a number of aids have been developed to assist the fastening of the connectors of pieces of jewelry, none provide the ease of use and flexibility that many fastener's demand. An aid for the fastening and unfastening of lobster claw and spring-ring type jewelry connectors is needed that can readily retain the connector in an open position to facilitate the fastening and unfastening of the connectors.

SUMMARY OF THE INVENTION

A pair of pliers is described that comprises a first proximal handle is connected to a first distal jaw. The first jaw includes an inwardly facing surface that defines a notch. The first handle and the first jaw define a first longitudinal axis. The notch is aligned with the first longitudinal axis. A second proximal handle is connected to a second distal jaw. The second jaw includes an elongate distal end portion. The elongate distal end portion has an arcuate shape. A joint connects the first handle and the first jaw for pivotal rotation relative to the second handle and the second jaw. A first length is defined by a distance from the joint to a terminal end of the first jaw and a second length is defined by a distance from the joint to a terminal end of the second jaw. The second length is longer than the first length.

A method is described for fastening and unfastening a piece of jewelry using a jewelry aid. The method comprises connecting a second jaw of a jewelry aid to a portion of a piece of jewelry in proximity to an annular structure of a clasp of the piece of jewelry. The method includes fixing the position of the portion of the piece of jewelry in proximity to the annular structure of the clasp at a position on a distal end portion of a second jaw of the jewelry aid. The method further includes connecting the first jaw to a lever of the clasp and moving the lever using the first jaw against a bias in the clasp. The moving of the lever opens an aperture in the annular structure of the clasp. The method includes inserting the opposing connector of the piece of jewelry into the clasp and disconnecting the first jaw from the lever to release the lever. The bias in the clasp moves the lever and closes the aperture in the annular structure of the clasp. The distal end portion of the second jaw is withdrawn from the portion of the piece of jewelry in proximity to the annular structure of the clasp.

BRIEF DESCRIPTION OF THE DRAWINGS

Preferred embodiments of the invention are described below with reference to the drawings, wherein like numerals are used to refer to the same or similar elements.

DETAILED DESCRIPTION

Figure 1:
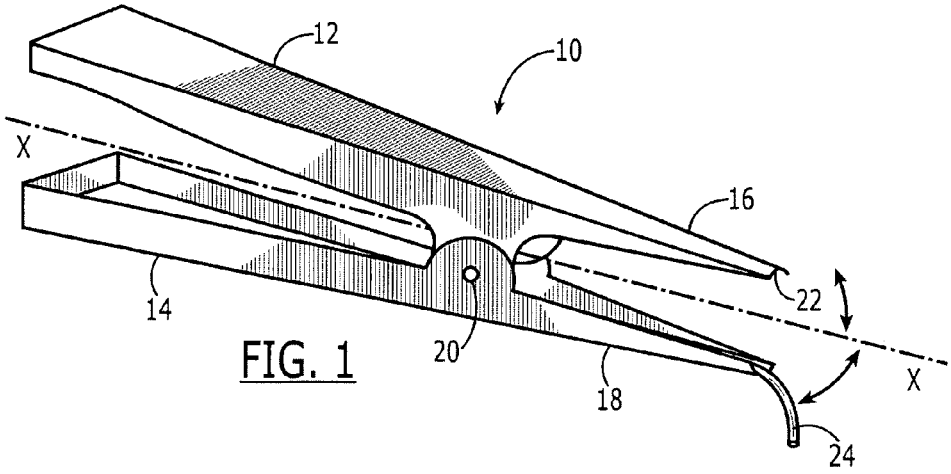
FIG. 1 is a side and top perspective view of a jewelry aid constructed in accordance with the present disclosure.

Referring to FIG. 1, a jewelry aid 10 is described that assists in the connecting of a biased jewelry connector with the opposing loop or chain portion of the connector. Jewelry aid 10 has a basic pliers construction with a first handle 12, a second handle 14, a first jaw 16, a second jaw 18 and a pivot 20. First handle 12 and first jaw 16 are joined at pivot 20 with second handle 14 and second jaw 18. A central longitudinal axis-X extends along a centerline through pivot 20 and equidistant between handles 12 and 14 as well as jaws 16 and 18. Pivotal joint 20 is biased to position jaws 16 and 18 to a closed position wherein jaws 16 and 18 are preferably in direct contact.

First jaw 16 has a first length and second jaw 18 has a second length that is longer than the length of first jaw 16. A distal end portion of first jaw 16 has an inner surface that includes a notch or channel 22. Channel 22 is aligned with a longitudinal axis defined by first jaw 16. Second jaw 18 has a distal end portion 24 that extends beyond the length of the first jaw 16 that preferably has an arcuate outwardly extending shape. The distal end portion 24 can be a continuous part of jaw 18 or a rigid wire connected to jaw 18, for example.

Figure 2:
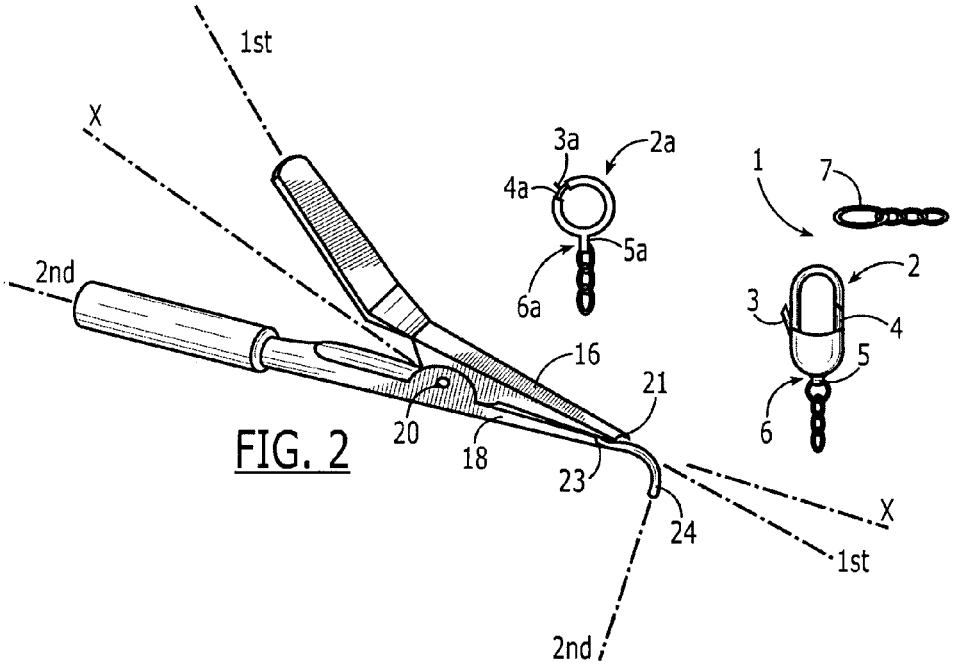
FIG. 2 is a side and top perspective view of a second embodiment of the jewelry aid of FIG. 1 in a closed position constructed in accordance with the present disclosure with an exemplary piece of jewelry.

Referring to FIG. 2, jewelry aid 10 has a structure that approximates an alligator clip, but it is understood that jewelry aid 10 in this and all the embodiments herein can have the structure of any kind pliers or tongs that provides the functions described herein. Pliers and tongs as defined herein are pincer type devices with jaws and handles that are commonly employed to perform functions such as holding small objects. Jewelry aid 10 has a first half that includes a first handle 12 and first jaw 16 and a second half that includes second handle 14 and second jaw 18. A proximal end portion of the first half includes first handle 12 and a distal end portion of the first half includes first jaw 16. A proximal end portion of the second half includes second handle 14 and a distal end portion of the second half includes second jaw 18. The first half defines a first longitudinal axis between handle 12 and jaw 16 and the second half defines a second longitudinal axis between handle 14 and jaw 18.

In this preferred embodiment, first handle 12 and second handle 14 extend proximally from joint 20 and have an ergonomic shape that is suitable for grasping. Handle 12 has a bent shape and/or an angular orientation from joint 20 that accommodates a predetermined range of motion between the closed position and the maximum opening defined by first jaw 16 and second jaw 18 in an open position of aid 10. Handle 12 in this preferred embodiment has a length of approximately 1.6 inches and provides sufficient leverage for ease of use against the bias of jewelry aid 10 that urges first jaw 16 and second jaw 18 to the closed position. Handle 14 in this preferred embodiment includes a proximally directed extension and has a total length of approximately 2.9 inches.

First jaw 16 and second jaw 18 extend distally along their respective axes from joint 20. Central longitudinal axis-X of aid 10 extends along a centerline through joint 20 and equidistant between handles 12 and 14 as well as jaws 16 and 18. In the second or open position of jewelry aid 10 jaws 16 and 18 are spaced apart.

First jaw 16 extends between joint 20 and a distal terminal end 21. Jaw 14 has an inwardly facing surface directed towards longitudinal axis-X that defines a notch 22 in proximity to terminal end 21. Notch 22 can extend proximally to define a channel that is approximately aligned with the longitudinal axis of first jaw 16. The longitudinal axis of first jaw 16 or a first longitudinal axis is defined between handle 12 and jaw 16. Notch or channel 22 has a distal terminal end in proximity to distal terminal 21 end of first jaw 16 that can be open or closed. In this preferred embodiment, jaw 16 has a length of approximately 0.8 inches.

Second jaw 18 extends between joint 20 and a distal terminal end of distal end portion 24. In this preferred embodiment, jaw 18 includes a proximal end portion 23 and distal end portion 24. Proximal end portion 23 includes an inwardly facing surface that opposes the inwardly facing surface of first jaw 16. The inwardly facing surface of proximal end portion 23 preferably includes an enhanced gripping surface that could include, for example, knurling, undulations and/or alternative gripping materials. In this preferred embodiment, the length of second jaw 18 is approximately 1.3 inches and the length of proximal end portion 23 is less than the length of first jaw 16 by approximately 0.1 to 0.3 inches.

The transition between proximal end portion 23 and distal end portion 24 includes an increase in cross-sectional area perpendicular to the second longitudinal axis from distal end portion 24 to proximal end portion 23. The transition between proximal end portion 23 and distal end portion 24 can take any form to include, for example, a taper or a stepped increment in cross-sectional area normal to the second axis. Alternatively, proximal end portion 23 can be an elongate structure with an inwardly facing surface as previously described.

Distal end portion 24 is an elongate structure that extends distally beyond the length of first jaw 16. Distal end portion 24 can be a continuous part of jaw 18 or a separate structure connected to proximal end portion 23. Distal end portion 24 includes a notch or detent 26 and a distal extension 28. Detent 26 is preferably in proximity to proximal end portion 23. Distal extension 28 has an arcuate shape that extends in an outward direction from the central longitudinal axis-X and defines a plane. The plane of distal extension 28 is approximately aligned with a plane defined by the first longitudinal axis defined by jaw 16 and longitudinal axis-X. The arcuate shape of distal extension 28 extends approximately the length of a semi-circle with a radius of approximately 0.3 inches. While the preferred shape of distal end portion 28 is arcuate it is understood that equivalent shapes of distal extension 28 as defined herein can approximate an arc such as for example, a plurality of straight chord like elements of an arc.

In this preferred embodiment, distal end portion 24 has a wire or rod type shape that is rigid or stiff. Distal end portion 24, however, can also include or be connected to proximal end portion 23 to include a controlled degree of resilience. Distal end portion 24 is preferably a piece of welding rod that has a diameter of approximately 0.03 inches and extends in the distal direction beyond the distal end of proximal end portion 23 at least approximately 0.2 inches and preferably between approximately 0.2-0.5 inches.

Continuing with the preferred embodiment of jaw 18, distal end portion 24 extends proximally a predetermined distance along and is connected to proximal end portion 23. It is understood, however, that while second jaw 18 extends distal to first jaw 16, the above parameters for the rigidity, cross-sectional shape, two or three dimensional shape, connection to proximal end portion 23, dimensions and alignment of distal end portion 24 are all factors that can be varied depending upon the desired application of jewelry aid 10.

Joint 20 connects the first half and the second half and provides for the independent movement of each half relative to the other half. In this preferred embodiment, jewelry aid 10 has an alligator clip type structure in which each half has a pair of longitudinally aligned and inwardly directed flanges. The flanges are positioned to overlap and a pin extends through the flanges as a hinge to provide the required independent rotation for each half. It is understood however, that joint 20 can take any known form of pliers, clip or tong type joint such as a lay-on, single or box as well as a flexible or resilient joint that includes the translation and/or pivoting of each half of jewelry aid 10.

As described previously, jewelry aid 10 is biased to the closed position wherein first jaw 16 and second jaw 18 are preferably in direct contact. In this preferred embodiment, joint 20 includes a bias member that coils around the pin and has terminal end portions that urge jaws 16 and 18 towards the central longitudinal axis-X. The bias member, however, can be any form of resilient energy storage device that provides a suitable displacing force to urge jaws 16 and 18 to the closed position such as leaf springs or a resilient polymer structure, for example.

Continuing with FIG. 2, jewelry aid 10 is adapted to interface with or in proximity to a clasp 2 of an exemplary piece of jewelry 1. In this example, piece of jewelry 1 includes an ornamental portion and a connector portion. The ornamental portion can be any type of ornamentation and include individual components such as chain links, costume jewels, precious metals, precious jewels or any other arrangement that forms a piece of jewelry 1 that can be a bracelet, an anklet or a necklace, for example. The connector portion of piece of jewelry 1 and is a standard lobster claw clasp 2 or a spring-ring type fastener 2*a*.

Clasp 2 has an annular structure that includes a lever 3, a movable arm or segment 4, and a base 5 that defines an aperture 6. Lever 3 extends outward from the annular structure of clasp 2 and has a terminal end or tip. Lever 3 is connected to movable segment 4 and is rotatingly connected to the annular structure of clasp 2. Lever 3 is biased to a first position and pivots against the bias to a second position. Segment 4 is a movable portion of the annular structure of clasp 2 that moves approximately simultaneously with the movement of lever 3. Moving lever 3 between the first position and the second position moves segment 4 between a first closed position and a second open position of the annular structure of clasp 2. The release of lever 3 in the second position results in the bias urging lever 3 from the second position to the first position and moving of segment 4 from the open position to the closed position.

Base 5 connects to the annular structure of clasp 2 and to piece of jewelry 1. In this exemplary embodiment, aperture 6 of base 5 connects to the ornamental portion of piece of jewelry 1. An opposed or second terminal end of the piece of jewelry 1 includes a connector 7 that is typically a solid unbroken annular structure. Aperture 8 of clasp 2 has sufficient size for the passage of a portion of the annular structure of connector 7 into the annular structure of clasp 2 and the subsequent release and fastening of the connectors of piece of jewelry 1 together.

Clasp 2 as defined herein includes connectors, such as spring-rings clasps 2*a* and other similar jewelry connectors. Clasp 2*a* includes a lever 3*a* that is connected to and extends outwardly from a portion of the annular structure that is movable segment 4*a*. In clasps 2*a*, movable segment 4*a* typically telescopes into of the annular structure to define an aperture (not shown). Movable structure 4*a* moves between a first closed position and a second open position. Clasps 2*a* are typically biased to the closed position. Clasp 2*a* can selectively omit base 5*a* as described herein.

Clasps 2 can combine components or components may have different angular orientations. For example, the centerline of the aperture defined by the annular structure of clasp 2, as shown herein, is offset approximately ninety degrees from the centerline of aperture 6 of base 5. The angular relationship between the centerlines of the aperture of the annular structure of clasp 2 and aperture 6 can vary from one piece of jewelry 1 to another, but the centerlines are typically approximately aligned or approximately ninety (90) degrees apart. In any of the above angular relationships, jewelry aid 10 can still interface with clasp 2 as described herein.

The materials of construction of jewelry aid 10 can include any materials that provide the required structured integrity and bias described herein to include for example metals, glass and/or glass fibers, polymers, composite materials and cellulose. Jewelry aid 10 can be fabricated using any means suitable for the structure described herein to include stamping, molding, grinding, cutting and machining, for example. The structures added in this preferred embodiment, such as the extensions to first handle 12, second handle 14 and distal end portion 24 can be monolithically formed or connected using processes such as, for example, welding, heat bonding, mechanical fittings/devices, adhesives, and/or brazing.

Figure 3:
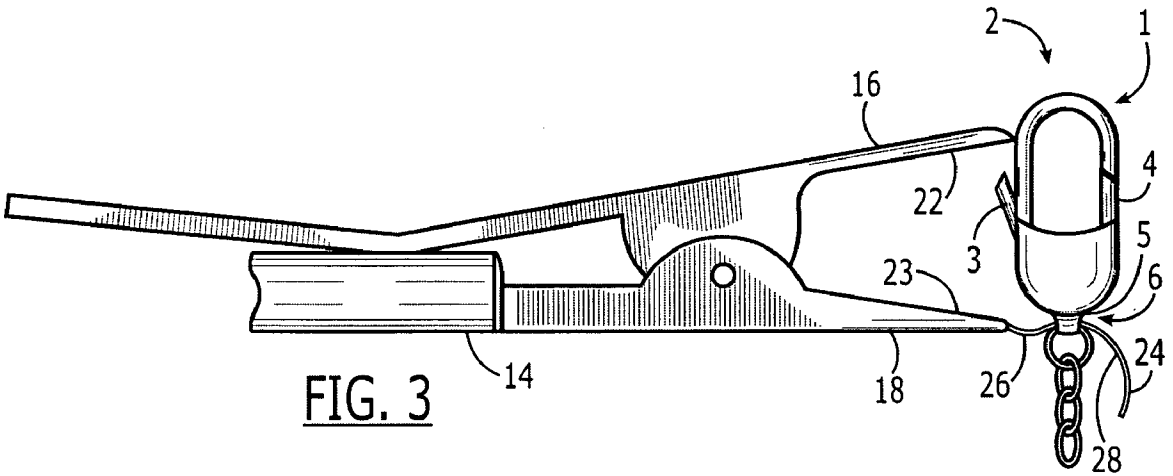
FIG. 3 is a side view of the jewelry aid and the exemplary piece of jewelry of FIG. 2, the jewelry aid in an open position and engaged with a clasp of the exemplary piece of jewelry, the clasp in a closed position.

Referring now to FIG. 3 jewelry aid 10 distal end portion 24 is inserted into aperture 6 of base 5 of clasp 2. The arcuate outward shape of distal extension 28 assists in retaining the connection between second jaw 18 and base 5 and can be selectively employed to fix the position of clasp 2 relative to aid 10. The amount of distal end portion 24 that is inserted through aperture 6 can vary from base 5 abutting the transition to proximal end portion 23 to the terminal end of distal extension 28. The shape and length of distal end portion 24 advantageously assists in the retention of clasp 2 on distal end portion 24 and increases the versatility of aid 10 by accommodating a broad range of sizes, types, styles and shapes of clasps 2.

Clasp 2 is fixed in a desired position on distal end portion 24 by creating a frictional bind. The arcuate nature of distal end portion 24 readily creates a frictional bind with the walls of base 5 that define aperture 6 by the changing angle of notch 26 or distal extension 28. This process can also include inclining clasp 2 relative to distal end portion 24. A position for binding is selected that will accommodate the engaging of notch or channel 22 of first jaw 16 with lever 3 in the open position. It is understood that distal end portion 24 can have alternative shapes and/or include surface variations such as undulations that perform the same function as arcuate distal end portion 24 of fixing the position of clasp 2 on second jaw 18 of jewelry aid 10.

Figure 4:
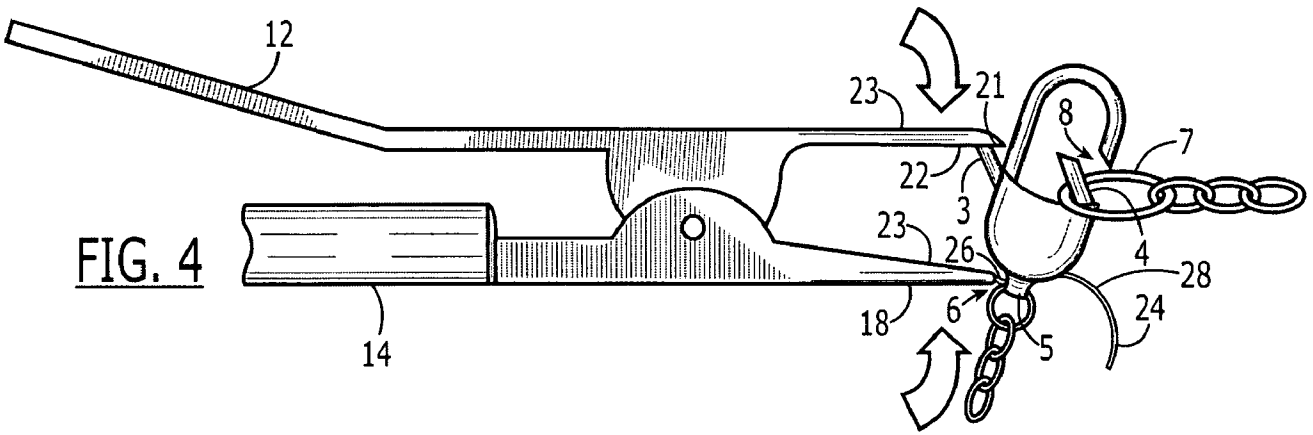
FIG. 4 is the side view of the jewelry aid and the exemplary piece of jewelry of FIG. 3, the jewelry aid in the open position and engaged with the clasp, the clasp in an open position and the opposing connector of the piece of jewelry received within the clasp.

As shown in FIGS. 3 and 4, notch 22 is constructed to receive the distal tip of lever 3 and retain its connection with the distal tip throughout the movement of lever 3 between the first and second position of clasp 2. Once notch 22 of jaw 16 engages lever 3 and clasp 2 is fixed in position on distal end portion 24, handles 12 and 14 of jewelry aid 10 can be released. The bias member urges jaws 16 and 18 toward the closed position and moves lever 3 and movable segment 4 to the second position to define aperture 8 in the annular structure.

Alternatively, clasp 2 can be fixed relative to jaw 18 by inserting distal end portion 24 into the ornamental portion of piece of jewelry 1 such as, for example, a link of chain or a coupling between individual components in the ornamental portion in proximity to clasp 2. In still another alternative, proximal end portion 23 directly engages the annular structure of clasp 2 on or in proximity to base 5. This alternative method fixes the position of clasp 2 for the connecting of first jaw 16 with lever 3 using the inwardly facing surface of jaw 18 and preferably that of proximal end portion 23 without the insertion of distal end portion 24 into any aperture in piece of jewelry 1. This latter alternative is particularly advantageous when distal end portion 24 cannot or is elected not to be inserted into piece of jewelry 1. For example, distal end portion 24 cannot be inserted into piece of jewelry 1 in many instances when base 5 is omitted, distal end portion 24 cannot be inserted into aperture 6, or the components of the ornamental portion and/or their connections in piece of jewelry 1 prevent the insertion of distal end portion 24.

Referring now to FIG. 4, jewelry aid 10 and clasp 2 are in the open position. Clasp 2 is retained in the open position by the combination of first jaw 16 engaging lever 3, second jaw 18 engaging aperture 6 of base 5 and the urging of the bias member. In this example, clasp 2 is positioned in detent 26 and jaw 16 has engaged lever 3 in notch 22 that includes a closed or cupped distal terminal end 21. The reduced length of proximal end portion 23 relative to the length of first jaw 16 provides a preferred proximal positioning of clasp 2 in detent 26 that can advantageously accommodate the engagement of jaw 16 with lever 3. The bias member force is represented by the arrows that show jaws 16 and 18 urged to the closed position. The force of the bias member displaces lever 3 to the limit of its travel and simultaneously displaces movable segment 4 in this exemplary lobster claw clasp 2 to define the maximum aperture 8 in the annular structure.

The force in which the bias member urges jaws 16 and 18 to the closed position assists in the retaining of jewelry aid 10 in an engaged position with clasp 2 in the open position. This enables a user of aid 10 to advantageously manually release handles 12 and 14 and place the engaged jewelry aid 10 and piece of jewelry 1 down on a dresser, for example, until they are ready at a later time to engage the connectors together. Alternatively, the user can optionally hold handles 12 and/or 14, but preferably extended handle 14, and finely manipulate clasp 2 using jewelry aid 10 for fastening or unfastening with connector 7.

Jewelry aid 10 can advantageously perform the functions described herein with the structure of distal end portion 24 including solely detent 26 or solely distal extension 28. In this regard, detent 26 and distal extension 28 are retention mechanisms for clasp 2. The inclusion of both detent 26 and distal extension 28 increases the versatility of jewelry aid 10 in the broad range of sizes, types, styles and shapes of clasps 2.

Once annular connector 7 is engaged with clasp 2, the additional application of force in an inward direction on handles 12 and/or 14 against the urging of the bias member increases the opening between jaws 14 and 16 and releases lever 3 from engagement with first jaw 16. The bias of clasp 2 then closes lever 3 and movable segment 4 and securely locks the opposing connector 7 and clasp 2 of piece of jewelry 1 together. Second jaw 18 can be then be disengaged from piece of jewelry 1.

To unfasten a piece of jewelry 1, jewelry aid 10 opens clasp 2 as described above and then connector 7 is removed from clasp 2 through the aperture 8 defined in the annular structure of clasp 2. Jewelry aid 10 is then disconnected from clasp 2 as described above.

In the preceding specification, the invention has been described with reference to specific exemplary embodiments thereof. It will be evident, however, that various modifications, combinations and changes can be made thereto without departing from the broader spirit and scope of the invention as set forth in the claims that follow. For example, the dimensions described herein are in relation to this one preferred embodiment and it is understood that the dimensions of jewelry aid 10 can be modified, scaled up and/or scaled down for a given application. In addition, while in the preferred embodiment jewelry aid 10 is a modified alligator type clip, jewelry aid 10 is not limited to this particular structure and can take any pliers or tong type structure. Similarly, while notch 22 can be defined as a slot, cut, channel or indentation, functionally equivalent structures such as projecting teeth, walls or undulations can define a similar structural shape that is encompassed by the term notch. Joint 20 is described as a pivotal joint, but other alternative positions on aid 10 and alternative equivalent mechanisms can provide for the relative movement of either half between the first and second positions. The bias member described herein can be selectively employed as an option that provides desirable functions, but is not essential for the fastening and unfastening operational use of jewelry aid 10. While the present invention is described in terms of a series of embodiments, the present invention can combine one or more novel features of the different embodiments. The specification and drawings are accordingly to be regarded in an illustrative manner rather than a restrictive sense.

What is claimed is:

1. A pair of pliers that comprises:

a first proximal handle connected to a first distal jaw, the first jaw includes an inwardly facing surface that defines a notch, the first handle and first jaw define a first longitudinal axis, the notch aligned with the first longitudinal axis;

a second proximal handle connected to a second distal jaw, the second jaw includes an elongate distal end portion that is a stiff wire, the elongate distal end portion has an arcuate shape;

a joint that connects the first handle and the first jaw for pivotal rotation relative to the second handle and the second jaw; and a first length defined by a distance from the joint to a terminal end of the first jaw and a second length defined by a distance from the joint to a terminal end of the second jaw, the second length being longer than the first length.

2. The pair of pliers of claim 1, wherein the notch of the first jaw is in proximity to a distal terminal end of the first jaw.

3. The pair of pliers of claim 2, wherein the distal terminal end of the notch in the first jaw is closed.

4. The pair of pliers of claim 1, wherein the arcuate shape of the distal end portion defines a plane and that plane is approximately aligned with a plane defined by a central longitudinal axis and a longitudinal axis defined by the first jaw, the central longitudinal axis extends along a centerline through the pivotal joint and equidistant between the handles and the jaws.

5. The pair of pliers of claim 1, wherein the distal end portion of the second jaw includes a detent and a distal extension, the distal extension includes the arcuate shape.

6. The pair of pliers of claim 1 wherein the joint includes a bias member.

7. The pair of pliers of claim 1, wherein the bias member urges the first jaw and the second jaw together.

8. The pair of pliers of claim 1, wherein the second jaw includes a proximal end portion and the proximal end portion has a length less than the first length.

9. The pair of pliers of claim 1, that further includes a central longitudinal axis that extends equidistantly between the jaws and the distal end portion of the second jaw extends in an outward direction from the central longitudinal axis.

10. An aid adapted for the fastening of the connectors of a piece of jewelry, the aid comprises:

a first proximal handle connected to a first distal jaw, the first jaw includes an inwardly facing surface that defines a notch, the first handle and the first jaw define a first longitudinal axis;

a second proximal handle connected to a second distal jaw, the second jaw includes a proximal end portion and an elongate distal end portion, the elongate distal end portion is a wire and the elongate distal end portion has a detent;

a joint that connects the first handle and first jaw for pivotal rotation with the second handle and the second jaw; and a first length defined by a distance from the joint to a terminal end of the first jaw and a second length defined by a distance from the joint to a terminal end of the second jaw, the second length being longer than the first length.

11. The pair of pliers of claim 10, wherein the notch of the first jaw is in proximity to a distal terminal end of the first jaw.

12. The pair of pliers of claim 11, wherein the distal terminal end of the notch in the first jaw is closed.

13. The pair of pliers of claim 10, wherein the detent in the distal end portion of the second jaw is in proximity to the proximal end portion.

14. The pair of pliers of claim 10, wherein the distal end portion of the second jaw includes an arcuate distal extension distal to the detent.

15. The pair of pliers of claim 10, wherein the first jaw and the second jaw are connected to a bias member and the bias member urges the first jaw and the second jaw together.

16. The pair of pliers of claim 10, wherein the proximal end portion of the second jaw has a length less than the first length.

17. The pair of pliers of claim 10, that further includes a central longitudinal axis that extends equidistantly between the jaws and the distal end portion extends in an outward direction from the central longitudinal axis.

18. The pair of pliers of claim 10, wherein the distal end portion has an arcuate shape that extends approximately the length of a semi-circle.

* * * * *